US009480371B2

(12) United States Patent
Lowe

(10) Patent No.: US 9,480,371 B2
(45) Date of Patent: Nov. 1, 2016

(54) SELF-SECURING ROLL HOLDER AND METHOD

(75) Inventor: Mark Jeffery Lowe, Bossier City, LA (US)

(73) Assignee: HARDWARE RESOURCES, INC., Bossier City, LA (US)

( * ) Notice: Subject to any disclaimer, the term of this patent is extended or adjusted under 35 U.S.C. 154(b) by 977 days.

(21) Appl. No.: 13/068,071

(22) Filed: May 2, 2011

(65) Prior Publication Data

US 2012/0280078 A1 Nov. 8, 2012

(51) Int. Cl.
*A47K 10/38* (2006.01)
*B65H 16/04* (2006.01)

(52) U.S. Cl.
CPC ..... *A47K 10/3836* (2013.01); *A47K 10/38* (2013.01); *A47K 2201/02* (2013.01)

(58) Field of Classification Search
CPC ..... A47K 10/00; A47K 10/16; A47K 10/18; A47K 10/22; A47K 10/32; A47K 10/34; A47K 10/38; A47K 10/3836; A47K 2201/00; A47K 2201/02; A47K 2201/025; B65H 16/00; B65H 16/02; B65H 16/04; B65H 18/00; B65H 18/02; B65H 18/026; B65H 2301/4162; B65H 2301/41326; B65H 2402/33
USPC ..... 242/597, 597.1–597.8, 598, 598.2, 242/598.4–598.5
See application file for complete search history.

(56) References Cited

U.S. PATENT DOCUMENTS 3,266,742 A 8/1966 Pena
3,558,072 A * 1/1971 Wakahara ..... 242/597.3
3,612,423 A 10/1971 Bahnsen
3,863,856 A 2/1975 Conlon, Jr.
4,373,682 A 2/1983 Dickson
4,462,555 A 7/1984 Olson et al.
4,726,179 A 2/1988 Smith et al.
4,741,439 A 5/1988 Bizic
D298,597 S 11/1988 Bell
D304,402 S 11/1989 Van Hoose
5,284,305 A 2/1994 Gassmann et al.
5,297,749 A 3/1994 White
5,454,500 A 10/1995 Chen
5,456,420 A 10/1995 Frazier
5,653,403 A 8/1997 Ritchey
6,405,972 B1 6/2002 Wakam
D486,681 S 2/2004 Hoernig
6,820,838 B2 11/2004 Martin et al.
D510,014 S 9/2005 Sung
D518,985 S 4/2006 Yang et al.
7,264,196 B2 9/2007 Guay et al.
D555,954 S 11/2007 Yang et al.

* cited by examiner

*Primary Examiner* — Michael Mansen
*Assistant Examiner* — Juan Campos, Jr.
(74) *Attorney, Agent, or Firm* — Schultz & Associates, P.C.

(57) ABSTRACT

A self-securing roll holder for easily exchanging rolls of sheet material. The holder comprises a mounting bracket, an mounting stanchion, a support, and a cap. The cap is pivotally connected to the support with a resilient retaining assembly. The cap has dimensions that allow the cap to act as a retainer in one position and, when moved to a second position, allow rolls of sheet material to be mounted and dismounted from the support. The retaining assembly further comprises a piston, a piston guide, a spring, and a pivot pin all of which are located inside the support. The cap is pivotally connected to the retaining assembly thereby maintaining forcible contact with the support and retaining rolls of sheet material on the support in one position until moved to a second position to exchange rolls.

23 Claims, 10 Drawing Sheets

SELF-SECURING ROLL HOLDER AND METHOD

TECHNICAL FIELD OF THE INVENTION

This disclosure relates to roll holders for paper products. More particularly, this disclosure relates to spring-loaded toilet paper holders for use in bathrooms.

BACKGROUND OF THE INVENTION

In the prior art, various designs and devices are known which dispense rolls of sheet paper material. However, many suffer from the problems of requiring the use of both hands to operate and placing components on dirty surfaces during reloading which can spread disease. One prior art approach is a casing around the rolls of sheet material to hold and dispense the sheet products. A casing type device usually requires the use of many parts and can be difficult to open so as to necessitate the use of both hands. In another typical prior art approach, a removable cap is employed on the end of the spindle to retain rolls of sheet material. Removable cap type devices are oftentimes inconvenient and cumbersome, requiring the use of both hands. The removable cap is easily lost or broken, reducing effectiveness of the device. Furthermore, in both types of prior art devices, parts of the device or the paper roll must be at least temporarily placed on potentially unsanitized surfaces during reloading.

Other examples exist in the art. U.S. Pat. No. 3,266,742 to Pena discloses a magazine holder and dispenser for storing and dispensing rolls of toilet paper. Rolls are dispensed by rotating the spindle in an arcuate path about an axis perpendicular to the axis of the roll. The spindle is operated by a vertical crankshaft which is turned to release and dispense a roll in the magazine. The crankshaft also operates an upper roller located in the magazine to prevent a second stored roll from dispensing. The spindle also allows the second roll to drop into a ready position to be dispensed at a later time. This device requires the use of a separate lug, which is attached to the magazine, to secure a roll of sheet material on the spindle. There is no self-securing mechanism on the spindle itself.

U.S. Pat. No. 3,612,423 to Bahnsen, discloses a paper dispenser with a casing, a vertical spindle, and a cam mechanism within the spindle. The cam mechanism includes a pair of cam balls that move between a retracted position and an extended position and a lock to secure the cam balls in the extended position. A pair of part-cylindrical arms surrounds the spindle and is hingedly connected to the casing by a toothed collar that inserts over the spindle for attachment to the upper end of the spindle. When the cam balls are in their extended position, the inner walls of the arms for moving them are in a roll-holding position. The lower end of each arm has a flange for holding rolls of tissue paper. This device requires a special key to release the cam balls in order the squeeze the arms together to release a roll of tissue paper.

U.S. Pat. No. 3,863,856 to Conlon, Jr. discloses a tape reel drive mechanism that incorporates a cam lever, which is rotatably mounted to the end of a bifurcated shaft of the drive member. A tape reel is locked onto the drive shaft when the cam lever is rotated to force a cam ball, which is supported by a spring, between the two shaft segments, thereby forcing the shaft segments to part and expand two O-rings that surround the shaft segments to forcibly contact the reel hub. This device is not designed for securing rolls of paper sheet material as is the art of this disclosure. Further, this device requires the use of a complicated cam ball and O-ring mechanism to secure a reel on the drive shaft. The mechanism may be prone to jamming.

U.S. Pat. No. 4,373,682 to Dickson discloses a paper holder with a spindle on a bracket. The spindle requires a resilient material frictionally engaging a central cardboard tube of a paper roll. One embodiment discloses a spindle having a slot therethrough extending axially. The resilient material is press-fit into the slot and projects laterally. Dickson requires a cover to enclose the paper roll, or a resilient material to frictionally engage the paper roll in order to secure it.

U.S. Pat. No. 4,462,555 to Olson, et al., discloses a support reel with a "quick-release" flange. The flange is secured to a hub with two identical quick-release locking mechanisms. Each locking mechanism has a pair of interlocking cylindrical members. A first cylindrical member, located on the hub, telescopically receives a second cylindrical member, which is mounted on the flange. Each cylindrical member supports a spring-biased plunger. Each hub-mounted member has a pair of multi-sectioned detent-receiving slots that receive a pair of locking pins that extend out from each flange-mounted member. The flange is secured to the hub when a screwdriver depresses and turns each flange-mounted member so that the locking pins are seated in the receiving slots. This device is not used in securing rolls of sheet material and requires interlocking members with locking pins. Also, the device requires an extra tool, i.e., a screwdriver to function.

U.S. Pat. No. 4,726,179 to Smith, et al., discloses a yarn spool retainer utilizing a yarn spool spindle having a spool retainer consisting of an outer sleeve with an inner plunger. The plunger is resiliently attached to the sleeve whereby the retainer can be placed in the spool and the plunger depressed and rotated to allow studs, which extend radially from the barrel into the bore, to engage with the spindle blade "J"-slots. This device requires two separate pieces, one of which can be lost, and must be used in a vertical position. The slots are prone to misalignment and jamming.

U.S. Pat. No. 4,741,439 to Bizic discloses a housing for a roll of photographic strip material on a spool. The housing consists of two frontal plates with bearing lugs for the rolls and a jacket that are held together with an axial threaded bolt. Multiple toggle positions of a handle, attached to the threaded bolt function to align the film on the spool. This device requires a housing and a threaded bolt to secure a roll on the spindle.

U.S. Pat. No. 5,297,749 to White discloses a paper roll holder with a removable cap that has pins to secure the roll. White relies on a removable cap, which can be lost, and protruding studs to secure rolls of sheet material.

U.S. Pat. No. 5,454,500 to Chen discloses a paper roll holder with a two-part casing that has an opening in the bottom to dispense sheet material. The paper roll is secured inside the casing by a rotary knob. In order to change a roll, a special key is inserted into the top of the casing, and the rotary knob is turned. The spindle is released, allowing the hinged casing to be opened. This device creates a difficult process of changing rolls of sheet material and relies on a casing with a rotary knob to secure rolls of sheet material.

The prior art fails to disclose or suggest a roll holder with a self-securing retainer that allows for easily mounting or removing rolls of sheet material with a sanitary procedure. Therefore, it is desirable to have a roll holder that secures a paper roll while allowing easy dispensing device that is of and is uncomplicated and allows for single-handed operation. It is also desirable to have a paper holder that is of a unitary construction to avoid multiple parts and lost or unsanitary pieces.

SUMMARY OF THE INVENTION

The inventor hereby discloses a self-securing roll holder with a unitary construction that can be adjusted to both retain rolls of sheet material and allow for an easy, single-handed exchange of rolls of sheet material.

One preferred embodiment comprises a mounting bracket, a mounting stanchion, a support, and a cap that is pivotally connected to a retaining assembly inside the support. The retaining assembly provides a first position of the cap to retain a roll of sheet material while allowing it to turn freely. A second position of the cap allows the roll to be exchanged.

In one embodiment, the retaining assembly includes a piston, a piston guide, and a spring. A pivot pin connects the piston to the cap. The piston guide is secured inside the support. The piston slides through the piston guide. The piston guide maintains the cap in linear alignment while allowing it to be moved between the first position and the second position.

BRIEF DESCRIPTION OF THE DRAWINGS

The disclosed embodiments will be described with reference to the accompanying drawings. Like pieces in different drawings carry the same number.

DETAILED DESCRIPTION

Figure 1A:
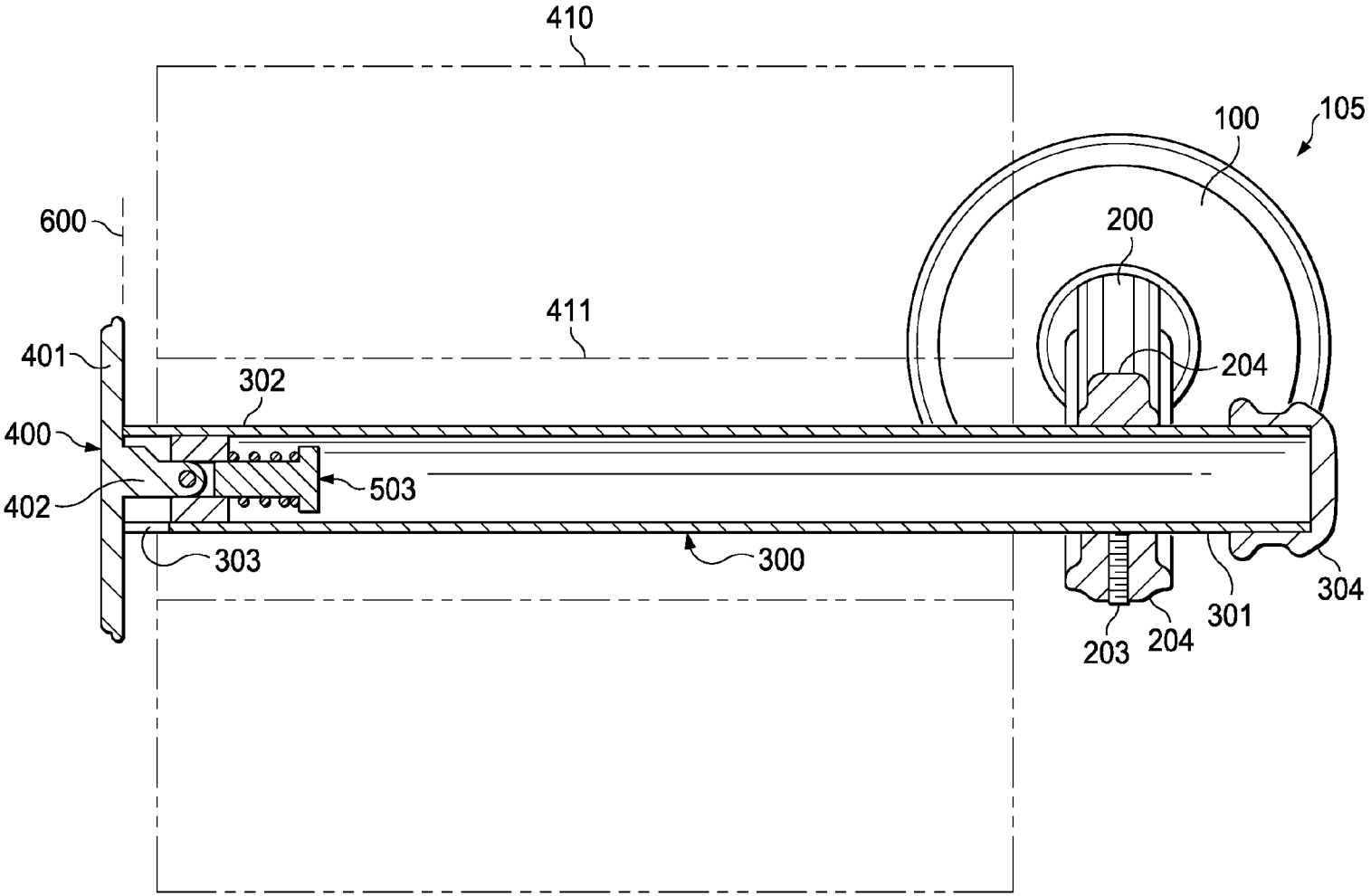
FIG. 1A is a side view of a preferred embodiment.
Figure 1B:
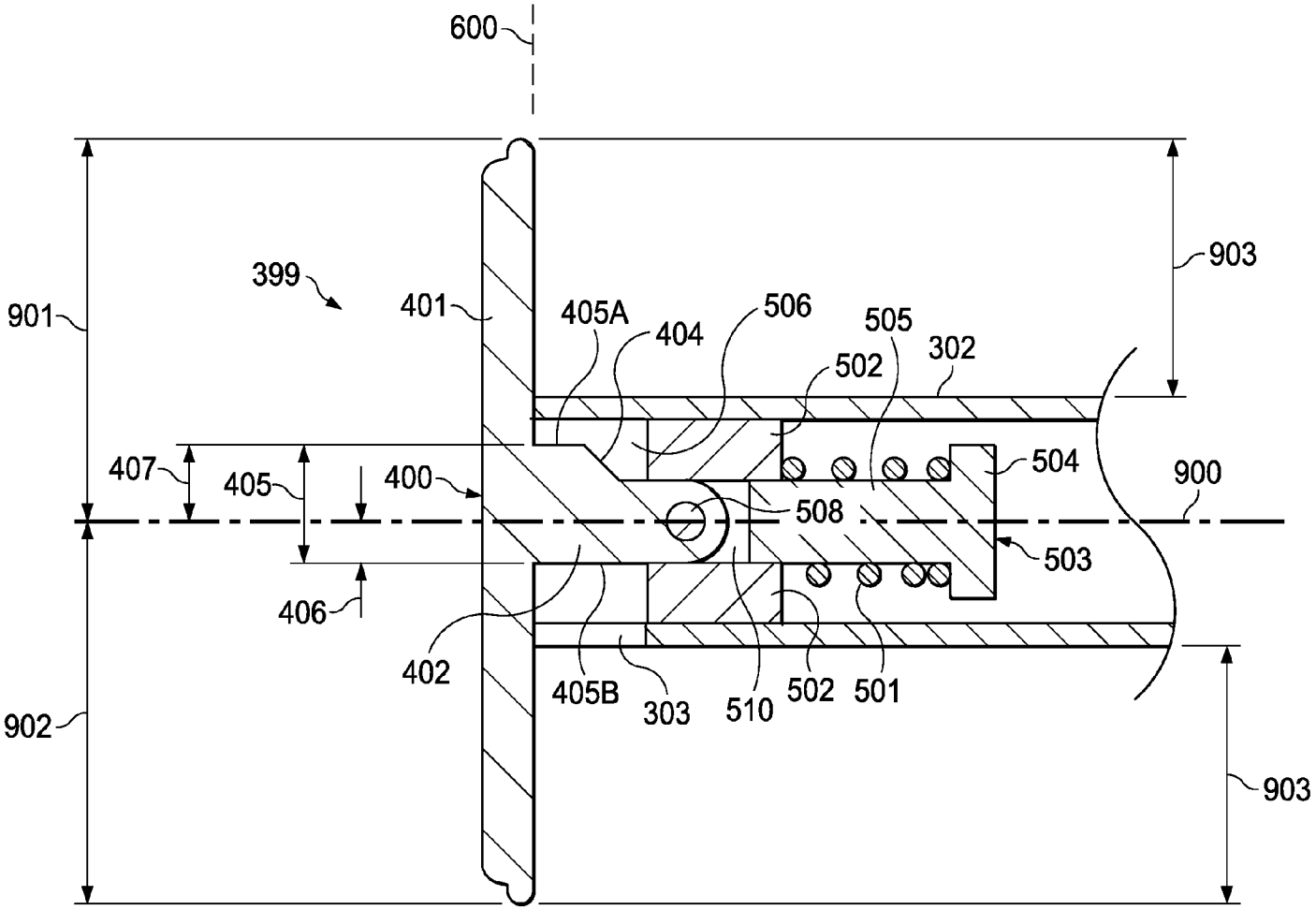
FIG. 1B is detail view showing the cap and retaining assembly of a preferred embodiment.
Figure 1C:
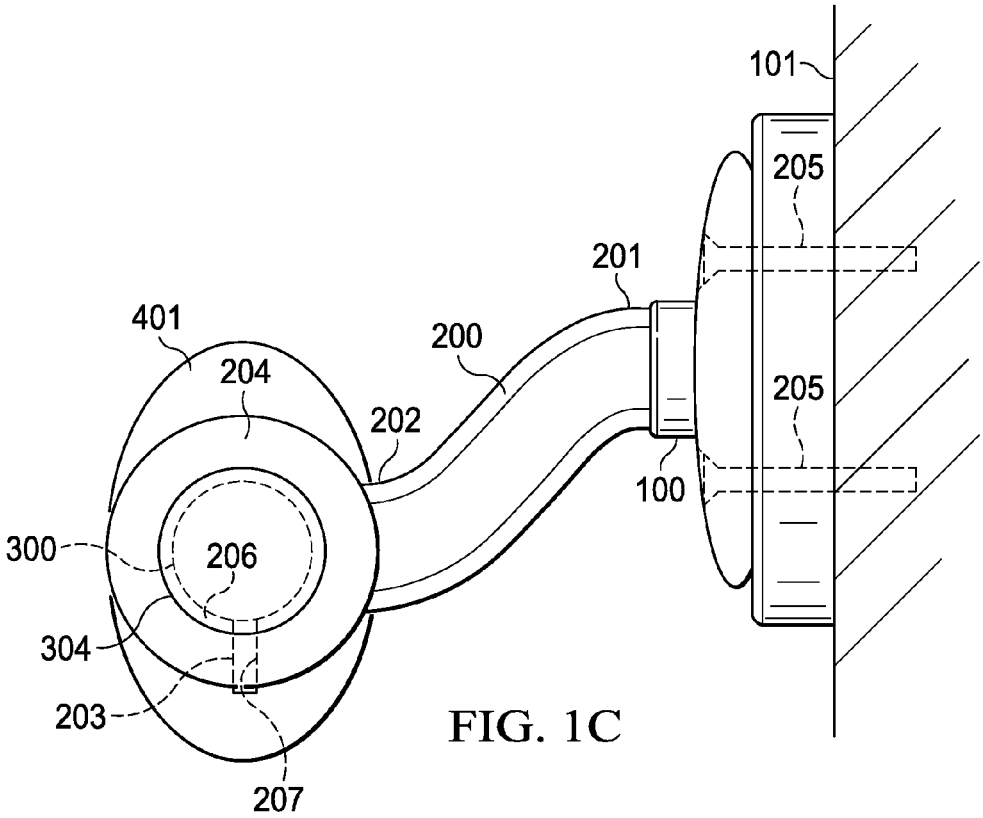
FIG. 1C is a side view of a preferred embodiment.

Referring to FIGS. 1A through 1C, a mounting bracket 100 supports a mounting stanchion 200, a support 300, and a cap 400. Mounting bracket 100 is generally mounted to a flat wall surface with fasteners 205. Mounting stanchion 200 has a first end 201 and a second end 202. First end 201 is rigidly attached to mounting bracket 100. Bracket 100 is attached to wall 101 by standard fasteners 205. Second end 202 is removably attached to securing collar 204. Securing collar 204 includes hole 206. Support 300 is secured to mounting stanchion 200 in hole 206. Securing collar 202 is adapted to receive a fastener 203 in hole 207. Fastener 203 is a conventional fastener such as a set screw. Decorative cap 304 is removably fitted to support 300. The length of mounting stanchion 200 is sufficient so that support 300 is placed at a distance so that a full roll of sheet material 410 when mounted on support 300 can freely rotate about support 300. Second end 302 includes slot 303. Support 300 may be oriented in securing collar 202 in "left-hand" and "right-hand" orientations. In the left-hand orientation, the support extends farther to the left of the securing collar. In the right-hand orientation, the support extends farther to the right of the securing collar. Support 300 can also be positioned in securing collar 202 at variable angles about its axis, thereby establishing a change in the rotation plane of cap 400 as will be further described.

Referring to FIG. 1B, cap 400 is secured in second end 302 by retaining assembly 399, which is located inside support 300. Cap 400 comprises facing 401 and facing support 402. Facing support 402 extends generally perpendicularly from facing 401 having first width 405, angled reduction 404, and second width 406. First width 405 is provided to strengthen the cap to resist fractures at the interface of facing 401 and facing support 402. Angled reduction 404 provides sufficient clearance to allow rotation of the cap without interference with support 302.

First width 405 includes top surface 405A and bottom surface 405B. Axis 900 is positioned distance 407 from top surface 405A and distance 406 from bottom surface 405B. In a preferred embodiment, distance 407 is greater than distance 406. Fixture surfaces of cap 401 extend to distance 903 from the outer surface of support 300. These dimensions are preferred but not critical.

The retaining assembly comprises a spring 501, a piston guide 502, a piston 503, and a pivot pin 508. Piston 503 includes flange 504 integrally formed with piston rod 505. In a preferred embodiment, the cross-section of the piston rod is rectangular to prevent axial rotation of the piston. In other embodiments, square, hexagonal and oval cross sections are employed. As will be recognized, other cross-section shapes that prevent axial rotation will also suffice. Piston guide 502 is rigidly attached to the inside surface of support 300 with a suitable adhesive. A press fit or crimp may also be employed with success. Piston guide 502 includes hole 510. In a preferred embodiment, the hole is rectangular to receive the piston rod. However, other shapes will suffice which cooperate with the shape of the piston rod to prevent axial rotation of the piston rod. Piston rod 505 is positioned in hole 510 and is sized to allow a sliding motion of the piston rod along its longitudinal axis. The piston guide is provided of sufficient width to constrain the piston rod to axial motion only. Flange 504 has a diameter greater than hole 510. Spring helical 501 surrounds piston rod 505 and urges flange 504 away from piston guide 502. In one preferred embodiment, helical spring 501 demonstrates a 3 lb/inch spring constant. Spring constants of between about 0.5 lb/inch and 10 lb/inch are preferred.

Figure 2:
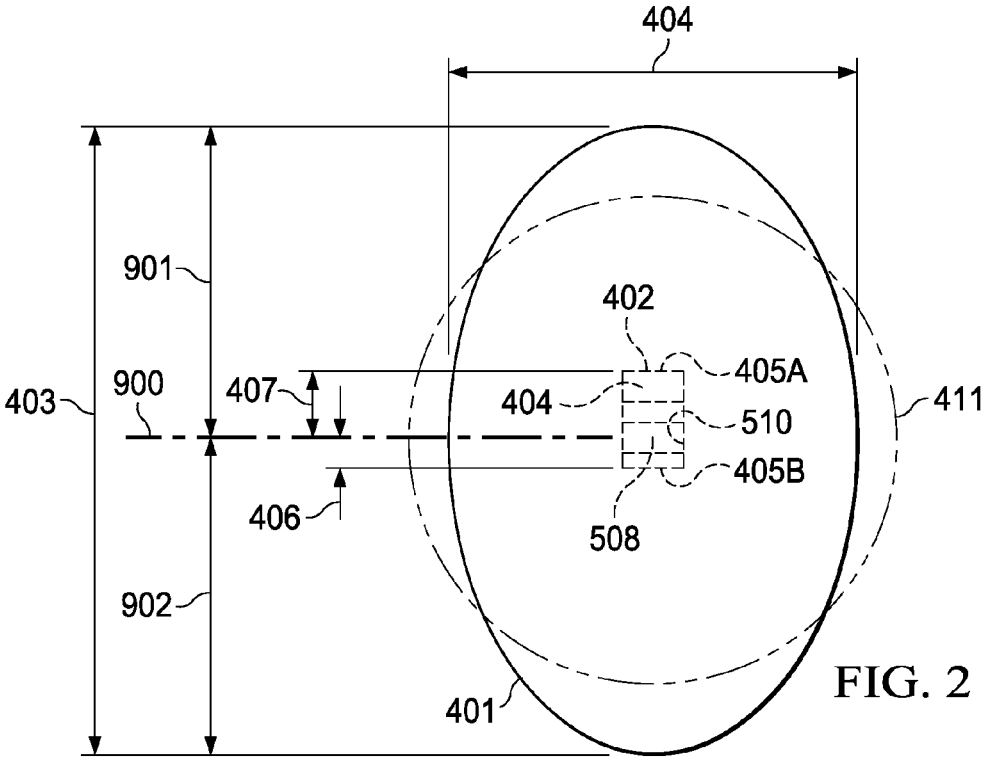
FIG. 2 is a cross-sectional view of a preferred embodiment of the cap.

Referring to FIG. 2, facing 401 has first dimension 404 that is less than the diameter of core 411 of the roll of sheet material. Second dimension 403 is greater than the diameter of core 411. Facing 401 retains a roll of sheet material by the interference of second dimension 403 with the roll.

Figure 3A:
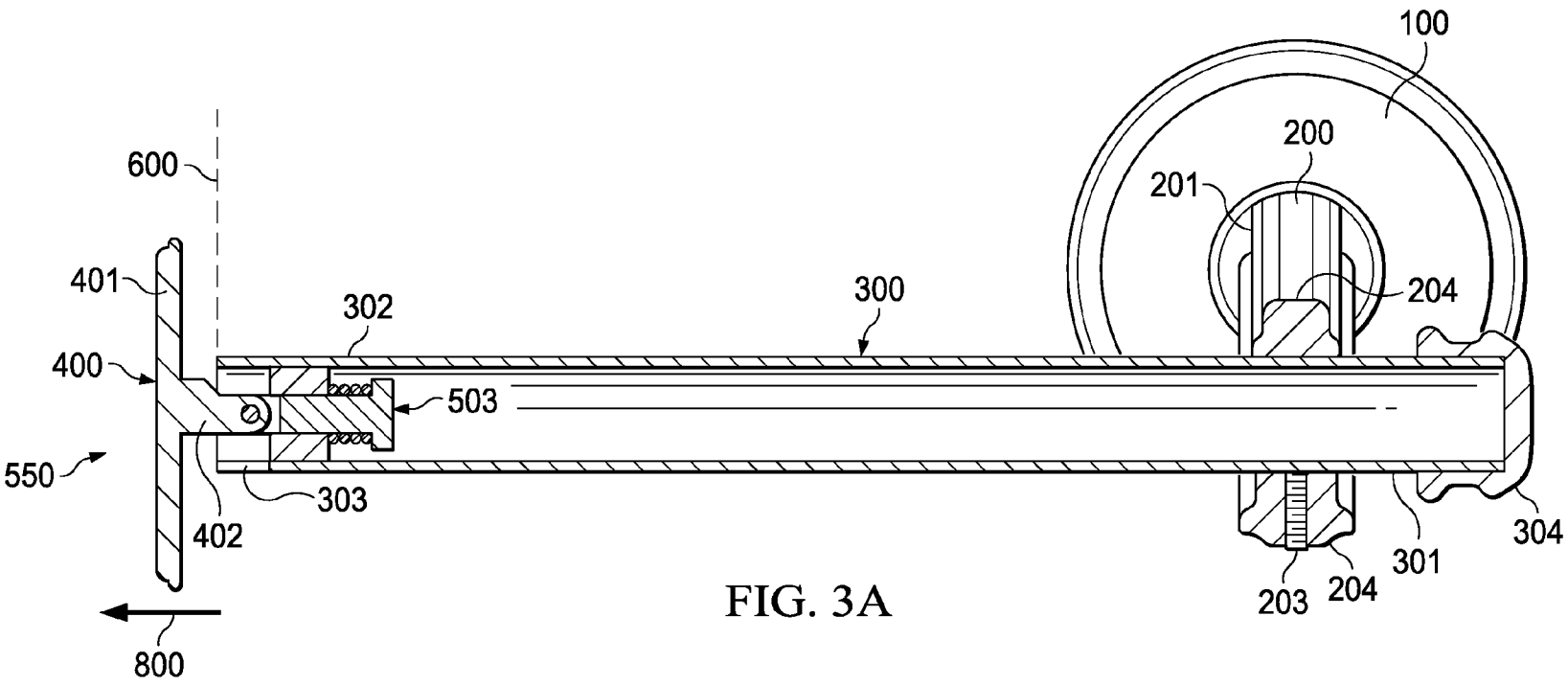
FIG. 3A is a side view of the holder with the cap in a displaced first position ready to be pivotally rotated to a second position.
Figure 3B:
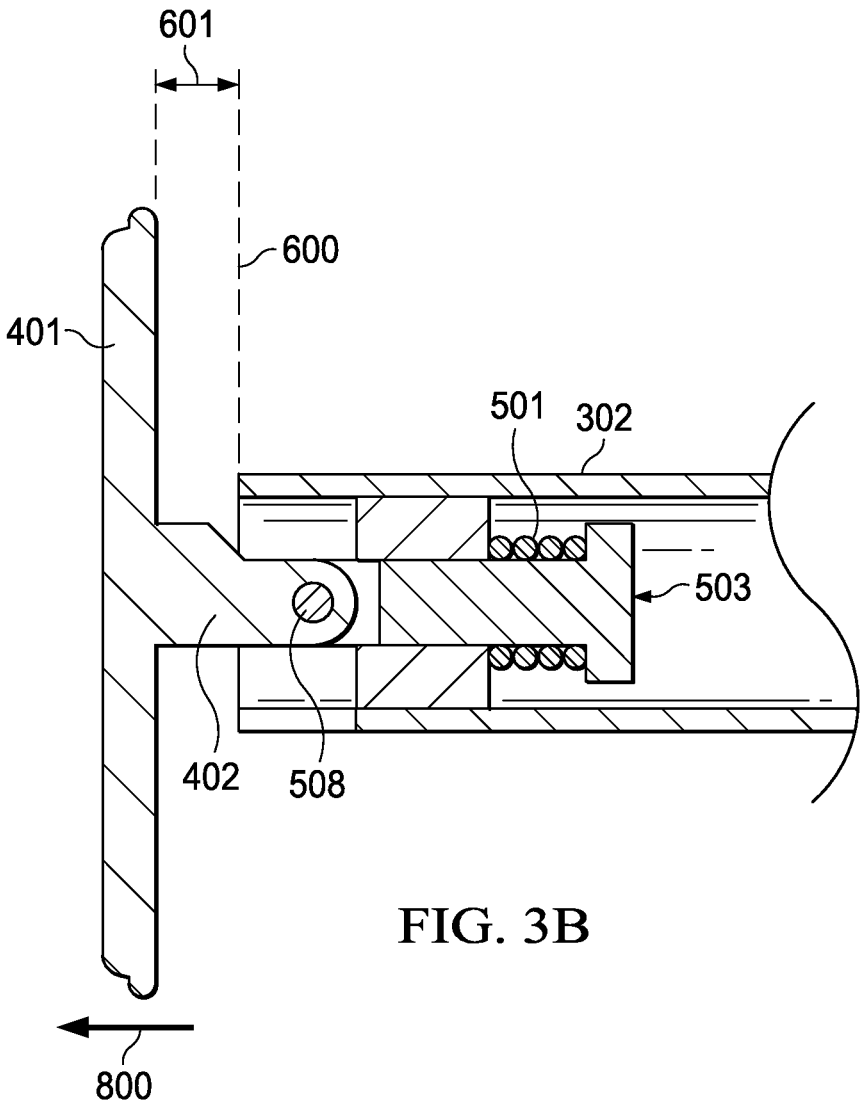
FIG. 3B is a detail view of a preferred embodiment.

Referring to FIGS. 3A and 3B, directional force 800 of approximately 3 pounds is applied to cap 400, thus displacing cap 400 from a first position 600 to an intermediate position thereby compressing helical spring 501. Force 800 displaces cap 400 by a distance 601, which is sufficient to allow cap 400 to be rotated about pivot pin 508.

Figure 4A:
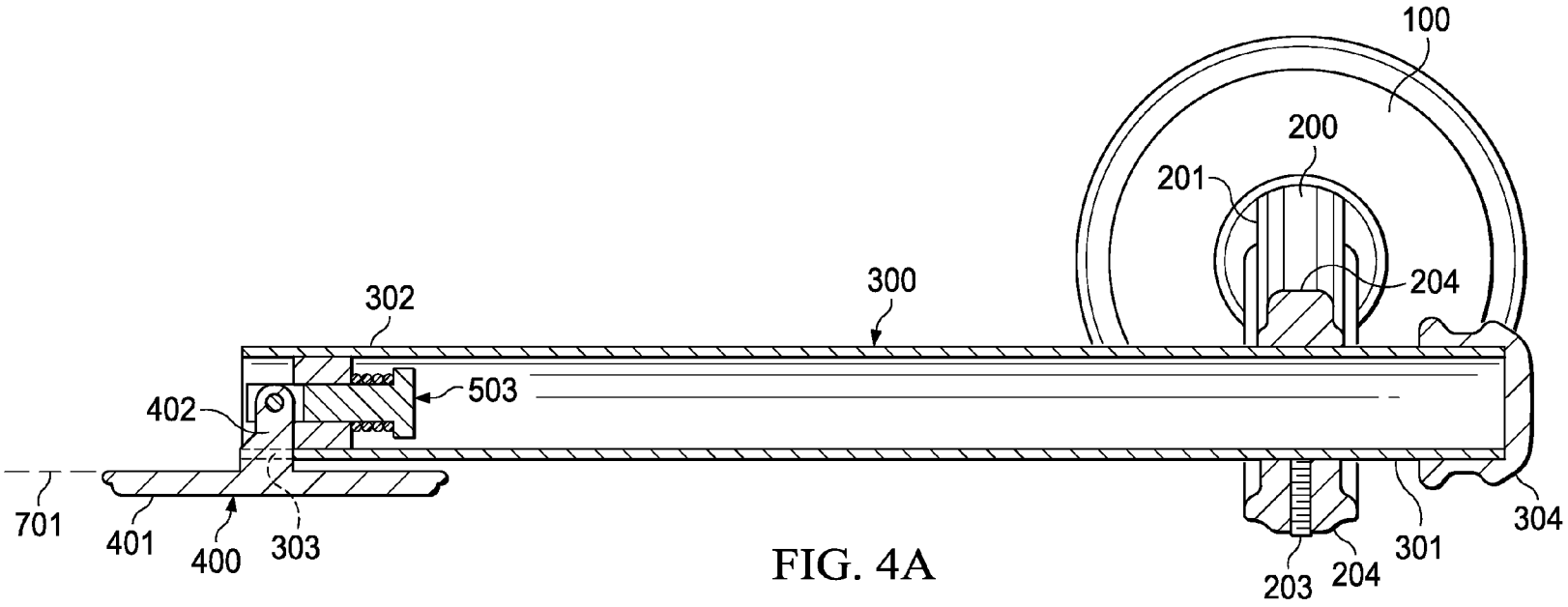
FIG. 4A is a side view of the cap in an open position to allow mounting and dismounting of a roll of sheet material.
Figure 4B:
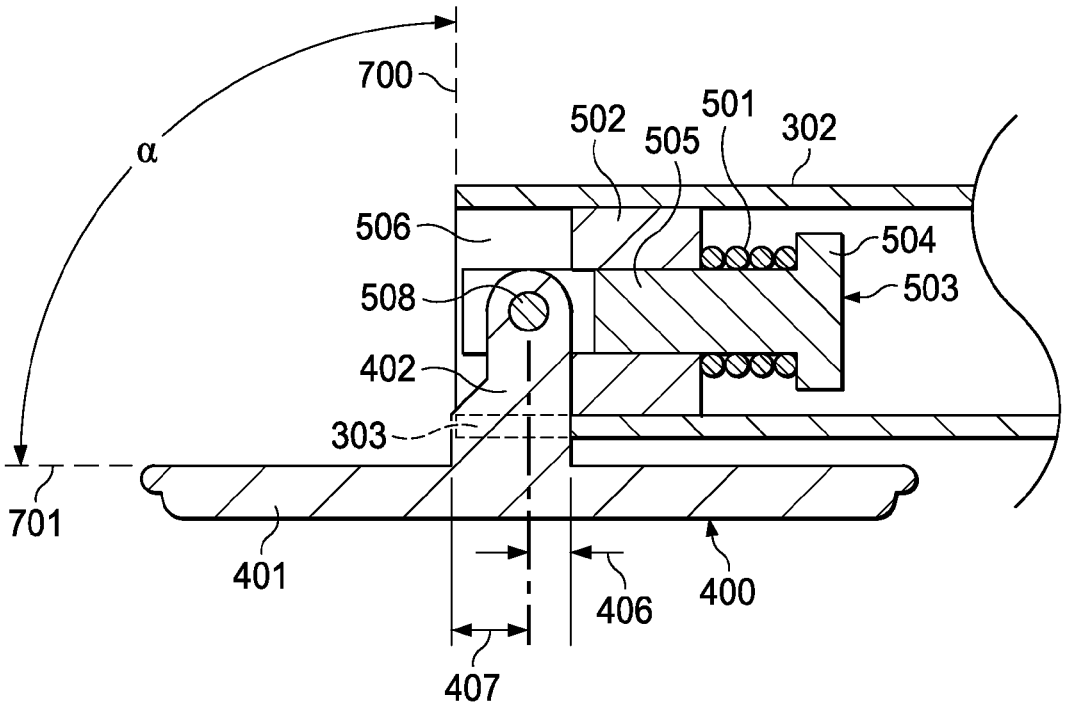
FIG. 4B is a detail view of the cap in an open position.

Referring to FIGS. 4A and 4B, cap 400 is shown rotated from its intermediate position at angle 700 to its second position at angle 701. Angle 700 and angle 701 are separated by an angular displacement α. In a preferred embodiment, angular displacement α is about 80° to 100°. Angle α defines a plane of rotation. The plane of rotation may be varied by repositioning the support in the collar.

In the second position, facing support 402 rests in slot 303. While at second position, a roll of sheet material 410 can either be mounted or dismounted by sliding it over cap 400 and onto support 300.

To return the cap from its second position to its first position, an opposite rotational force is applied to the cap, dislodging the support from slot 303. Spring 501 urges piston rod 503 rearwards, thereby rotating the cap into its intermediate position, through interference between the piston guide and the facing support. Once in the intermediate position, the bias provided by spring 501 automatically returns the cap of the intermediate position to the firs position.

In a preferred method of use, one hand is used to hold the roll of paper, while using one or more fingers of the same hand to move the cap from its first position to its second position. The roll may then be loaded and the same hand may be used to return the cap from the second position to the first position.

Neither the roll nor any part of the holder need be temporarily placed on a potentially unsanitary surface.

Figure 5A:
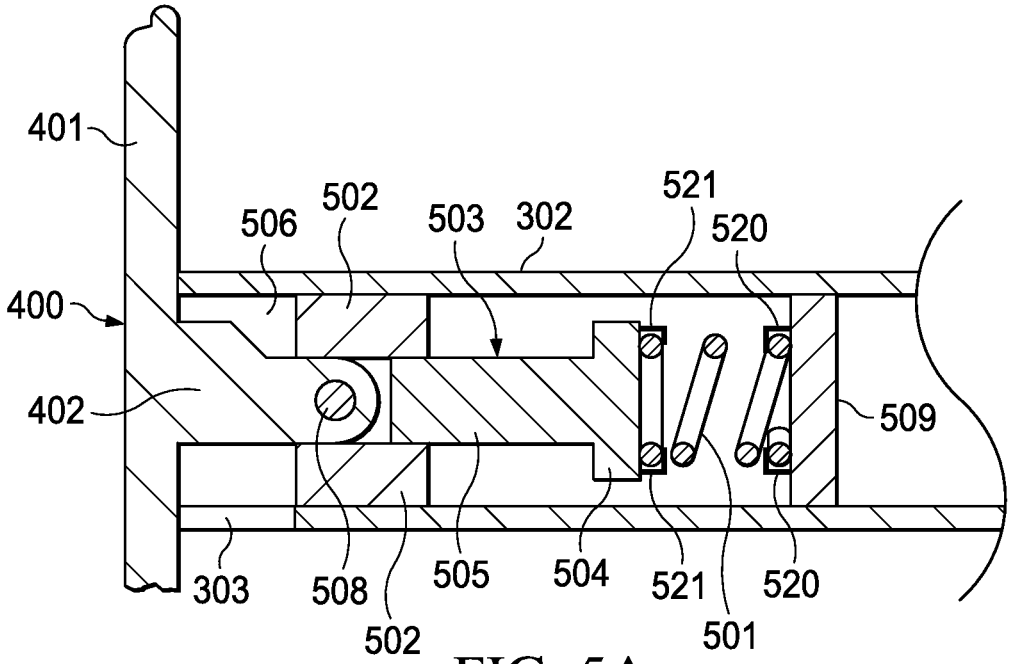
FIG. 5A is a partial section view of a preferred embodiment of the retaining assembly.

Referring to FIG. 5A, spring 501 is secured to retainer base 509 with securing bracket 520. Spring 501 is further secured to flange 504 with a securing bracket 521. Piston rod 505 slidingly moves through piston guide 502. Spring 501 applies a biasing force between retainer base 509 and flange 504.

Figure 5B:
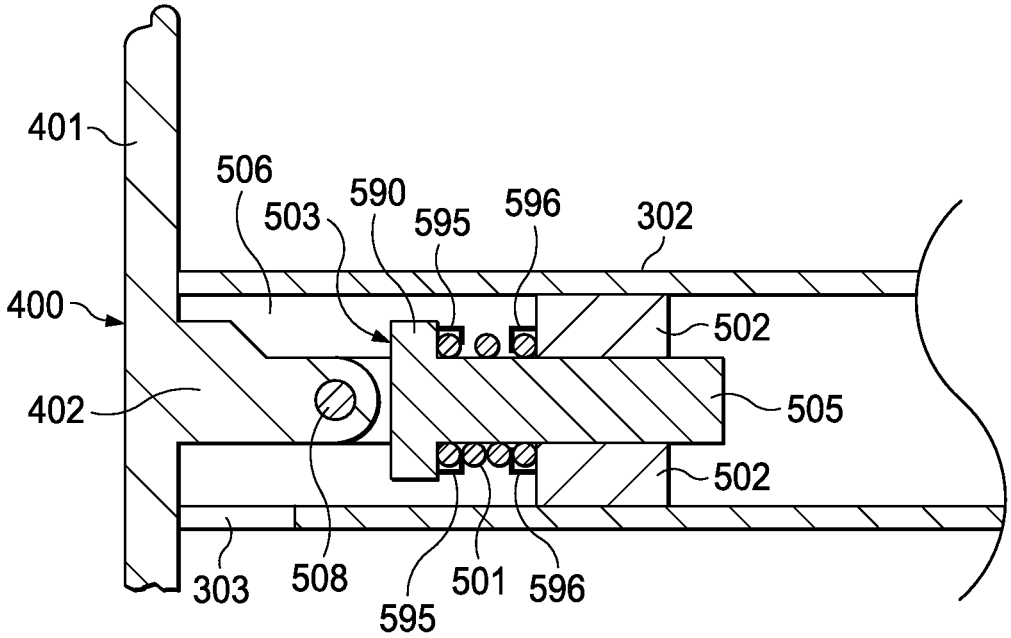
FIG. 5B is a partial section view of a preferred embodiment of the retaining assembly.

Referring to FIG. 5B, flange 590 is integrally formed with piston rod 505 in a central position. Spring 501 is secured to flange 590 with securing bracket 595, and to piston guide 502 with securing bracket 596. Spring 501 applies a biasing force between piston guide 502 and flange 590.

Figure 5C:
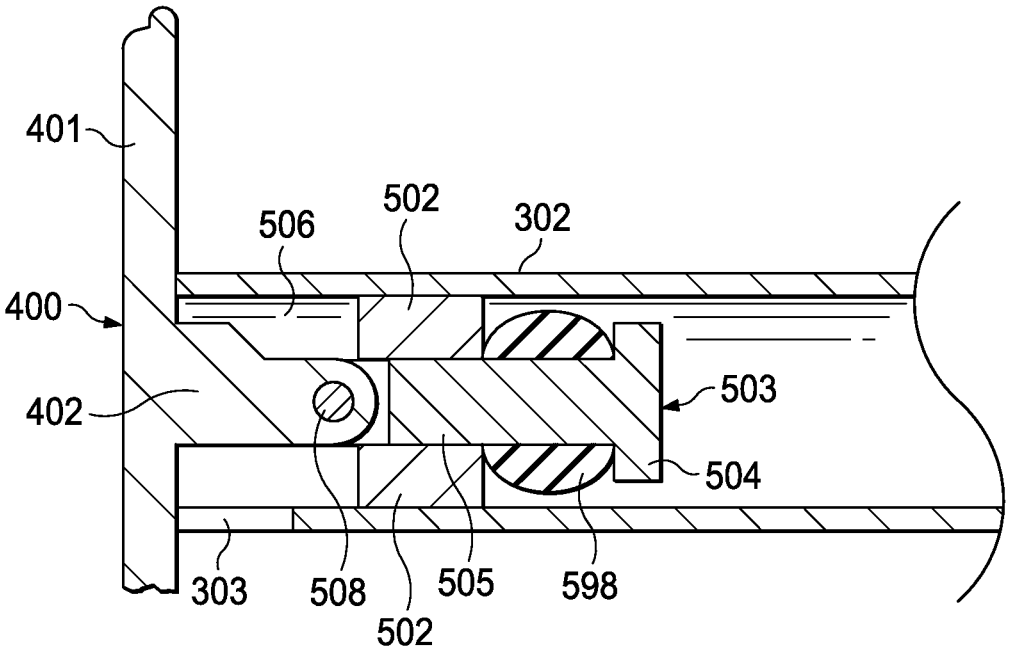
FIG. 5C is a partial section view of a preferred embodiment of the retaining assembly.

Referring to FIG. 5C, resilient retainer 598 is an annular ring which is formed of an elastomeric material, such as neoprene, and is shown positioned around the piston rod between flange 504 and piston guide 502. Other resilient materials will suffice.

Figure 5D:
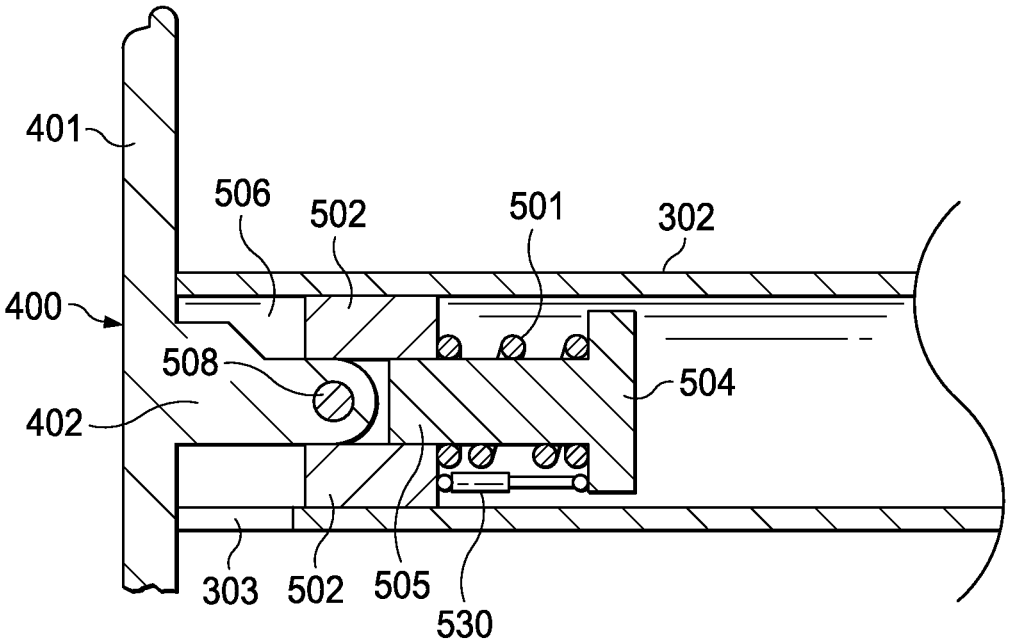
FIG. 5D is a partial section view of a preferred embodiment of the retaining assembly.

Referring to FIG. 5D, damper 530 is secured between piston guide 502 and flange 504. Damper 530 in a preferred embodiment is a fluid-filled piston/cylinder arrangement which slows the movement of the piston rod as induced by spring 501. In use, the damper prevents the cap from "snapping" into place against the support when rotated from its second position to its first position.

Figure 5E:
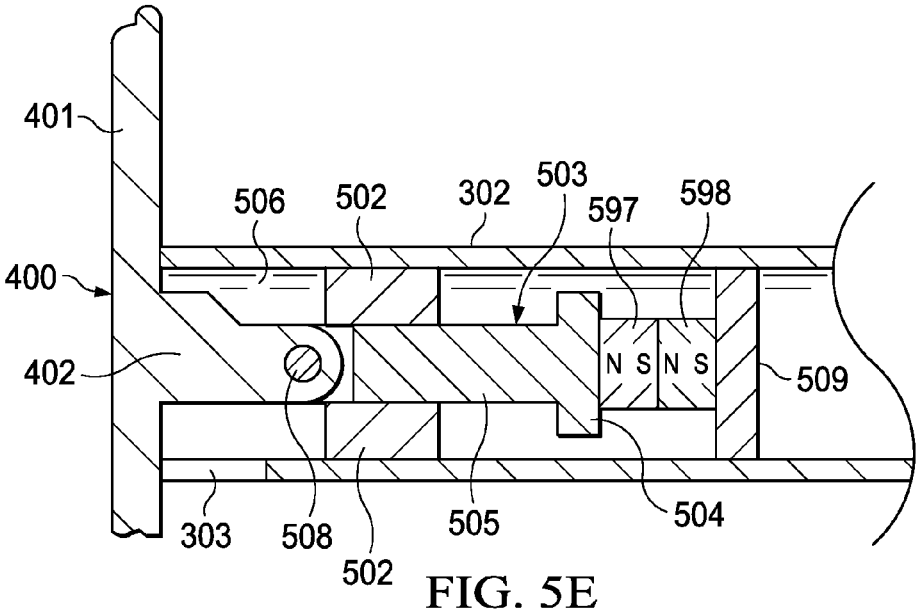
FIG. 5E is a partial section view of a preferred embodiment of the retaining assembly.

Referring to FIG. 5E, magnet 597 is secured to flange 504. Magnet 598 is secured to retainer base 509. Magnet 597 is secured to flange 504 through adhesive or other means known in the art. Magnet 598 is secured to retainer base 509 through adhesive or other means known in the art. From left to right, magnet 597 is orientated in a north-south position; magnet 598 is orientated in a south-north position. Opposite orientations will suffice. Piston 505 slidingly moves through piston guide 502. Magnet 597 and magnet 598 apply a bias force between retainer base 509 and flange 504.

Figure 6A:
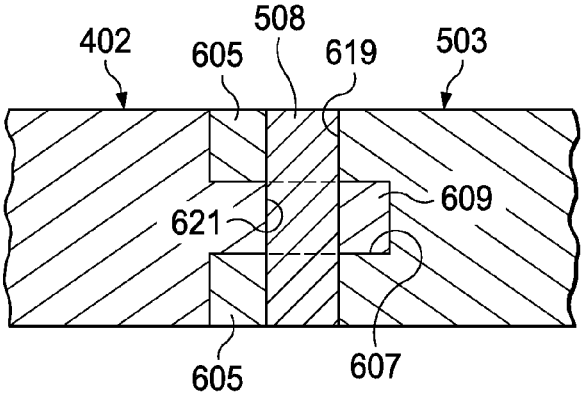
FIG. 6A is a partial section view a preferred embodiment of the cap and the retainer pin pivotally connected with the pivot pin.

Referring to FIG. 6A, piston 503 includes two extensions 605 forming a notch 607. Facing support 402 includes extension 609 which is fitted within notch 607. Extension 605 includes hole 619. Extension 607 includes hole 621. When assembled, pin 508 fits through hole 619 and hole 621 to form a pivotal joint between facing support 402 and piston 503.

Figure 6B:
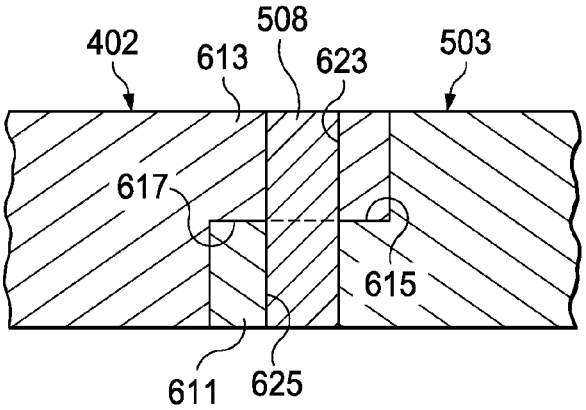
FIG. 6B is a partial section view of a preferred embodiment of the cap and the retainer pin pivotally connected with the pivot pin.

Referring to FIG. 6B, piston 503 includes extension 611 and notch 615. Facing support 402 includes support 613 and notch 617. Extension 613 includes hole 623. Extension 611 includes hole 625. When assembled, pin 508 fits into hole 623 and hole 625, thereby pivotally joining piston 503 with facing support 402.

Mounting bracket 100, mounting stanchion 200, support 300, cap 400, piston 503, and retainer base 509 in the preferred embodiment are formed of a light aluminum magnesium oxide. However, other rigid materials can be used such as polyvinyl chloride plastics or suitable durable materials as known in the art. The pivot pin and the helical spring are formed of spring steel.

It will be appreciated by those skilled in the art that modifications can be made to the embodiments disclosed and remain within the inventive concept. Therefore, this invention is not limited to the specific embodiments disclosed, but is intended to cover changes within the scope and spirit of the claims.

The invention claimed is:

1. A holder for retaining and releasing a paper roll comprising:
- a mounting bracket;
- a mounting stanchion fixedly attached to the mounting bracket;
- a support attached to the mounting stanchion;
- a sliding member guide attached to the support;
- a cap pivotally connected to a sliding member;
- a flange integrally formed with the sliding member;
- the sliding member slidingly engaged with the sliding member guide;
- a spring, adjacent to and biasing the sliding member guide and the flange;
- whereby the cap may be moved between a first position retaining the paper roll and a second position releasing the paper roll.

2. The holder of claim 1, wherein the length of the mounting stanchion is sufficient to position the support at a distance from the mounting bracket thereby enabling the paper roll to freely rotate about the support.

3. The holder of claim 1, wherein the support has a longitudinal axis, the holder further comprising:
- a collar, rigidly attached to the mounting stanchion, and releasably positioning the support about the longitudinal axis.

4. The holder of claim 1, wherein the cap engages a receiving slot in the support when in the second position.

5. The holder of claim 1, wherein the paper roll includes a core having a diameter and the cap is pivotally connected to the sliding member by a pivot pin, the cap further comprising:
- a first dimension generally perpendicular to the pivot pin; the first dimension greater than the diameter;
- a second dimension generally parallel to the pivot pin; and the second dimension less than the diameter.

6. The holder of claim 1, wherein the cap further comprises:
- a facing support extending generally perpendicularly from a facing;

the facing support having a first width and a second width; and, an angular reduction between the first width and the second width.

7. The holder of claim 1, wherein the cap rotates through an angle α between the first position and the second position.

8. The holder of claim 1, wherein the angle α is between about 80° and about 100°.

9. The holder of claim 1, wherein the spring is one of the group of helical spring, compression spring, tension spring, resilient annular ring and magnetic spring.

10. The holder of claim 1, wherein the spring has a spring constant of between about 0.5 lb/inch and about 10 lbs/inch.

11. A holder for retaining and releasing a paper roll comprising:

a mounting bracket;

a mounting stanchion fixedly attached to the mounting bracket;

a support attached to the mounting stanchion;

a cap, having a facing support extending from a facing;

a retainer guide attached to the support;

a retainer slidingly engaged with the retainer guide and pivotally connected to the facing support;

a biasing member positioned to bias the retainer with respect to the support;

a first cap position where the facing is generally perpendicular to the support;

a second cap position where the facing is generally parallel to the support; and, wherein the retainer includes a flange and the biasing member is in contact with the flange and the retainer guide and provides a compression bias between the flange and the retainer guide.

12. The holder of claim 11, wherein the retainer has a longitudinal axis and the retainer guide prevents rotation of the retainer about the longitudinal axis.

13. The holder of claim 12, where the support includes a slot adjacent to the facing support, further comprising:

the facing support is resident in the slot in the second cap position; and the cap is held in contact with the support by the biasing member in the first cap position.

14. The holder of claim 11, wherein the mounting stanchion further comprises:

an annular collar, surrounding the support, and variably fixing the support to the mounting stanchion.

15. The holder of claim 14, wherein the annular collar fixes the support in one of the group of a left-hand orientation and a right-hand orientation.

16. The holder of claim 11, wherein the support further comprises:

an end cover adjacent to the annular collar.

17. The holder of claim 11, wherein the paper roll has a loading hole with a diameter and the retainer is pivotally connected to the facing support by a pivot pin;

the facing has a first dimension greater than the diameter and a second dimension lesser than the diameter;

the first dimension is generally perpendicular to the pivot pin; and the second dimension is generally parallel to the pivot pin.

18. The holder of claim 11, wherein the facing further comprises:

a long axis, retaining the paper roll on the support in the first cap position; and a short axis, releasing the paper roll from the support in the second cap position.

19. The holder of claim 11, wherein the facing support extends generally perpendicularly from the facing, having a first width less than the diameter of the support, a second width, and an angular reduction between the first width and the second width.

20. The holder of claim 11, wherein the retainer guide is attached to an inside surface of the support.

21. The holder of claim 11 further comprising:

a retainer base, fixed to the support;

the biasing member connected between the retainer and the retainer base; and whereby the biasing member provides a force tending to move the cap from the second cap position to the first cap position.

22. The holder of claim 11, wherein the biasing member is attached to the retainer guide and the retainer, and provides a compression bias between the retainer guide and the retainer.

23. The holder of claim 11, wherein the biasing member is one of the group of helical spring, elastomeric spring, and magnetic spring.

* * * * *